United States Patent [19]

Plumlee

[11] 4,085,033

[45] Apr. 18, 1978

[54] HYDROGEN DONOR SOLVENT COAL LIQUEFACTION PROCESS

[75] Inventor: Karl W. Plumlee, Baytown, Tex.

[73] Assignee: Exxon Research & Engineering Co., Linden, N.J.

[21] Appl. No.: 755,175

[22] Filed: Dec. 29, 1976

Related U.S. Application Data

[63] Continuation-in-part of Ser. No. 686,813, May 17, 1976, Pat. No. 4,049,536, and a continuation-in-part of Ser. No. 686,814, May 17, 1976, Pat. No. 4,049,537, and a continuation-in-part of Ser. No. 686,827, May 17, 1976, Pat. No. 4,051,012, and a continuation-in-part of Ser. No. 686,828, May 17, 1976.

[51] Int. Cl.[2] ..... C10G 1/06

[52] U.S. Cl. ..... 208/10; 208/8

[58] Field of Search ..... 208/8, 10

[56] References Cited

U.S. PATENT DOCUMENTS 3,700,583 10/1972 Salamony et al. ..... 208/8

*Primary Examiner*—Delbert E. Gantz
*Assistant Examiner*—J. Thierstein
*Attorney, Agent, or Firm*—Llewellyn A. Proctor

[57] ABSTRACT

An indigenous hydrocarbon product stream boiling within a range of from about $C_1$–700° F., preferably $C_1$–400° F., is treated to produce an upgraded hydrocarbon fuel component and a component which can be recycled, with a suitable donor solvent, to a coal liquefaction zone to catalyze the reaction. In accordance therewith, a liquid hydrocarbon fraction with a high end boiling point range up to about 700° F., preferably up to about 400° F., is separated from a coal liquefaction zone effluent, the separated fraction is contacted with an alkaline medium to provide a hydrocarbon phase and an aqueous extract phase, the aqueous phase is neutralized, and contacted with a peroxygen compound to convert indigenous components of the aqueous phase of said hydrocarbon fraction into catalytic components, such that the aqueous stream is suitable for recycle to the coal liquefaction zone. Naturally occurring phenols and alkyl substituted phenols, found in the aqueous phase, are converted, by the addition of hydroxyl constituents to phenols, to dihydroxy benzenes which, as disclosed in copending Application Ser. Nos. 686,813 now U.S. Pat. No. 4,049,536; 686,814 now U.S. Pat. No. 4,049,537; 686,827 now U.S. Pat. No. 4,051,012 and 686,828, K. W. Plumlee et al, filed May 17, 1976, are suitable hydrogen transfer catalysts.

10 Claims, 1 Drawing Figure

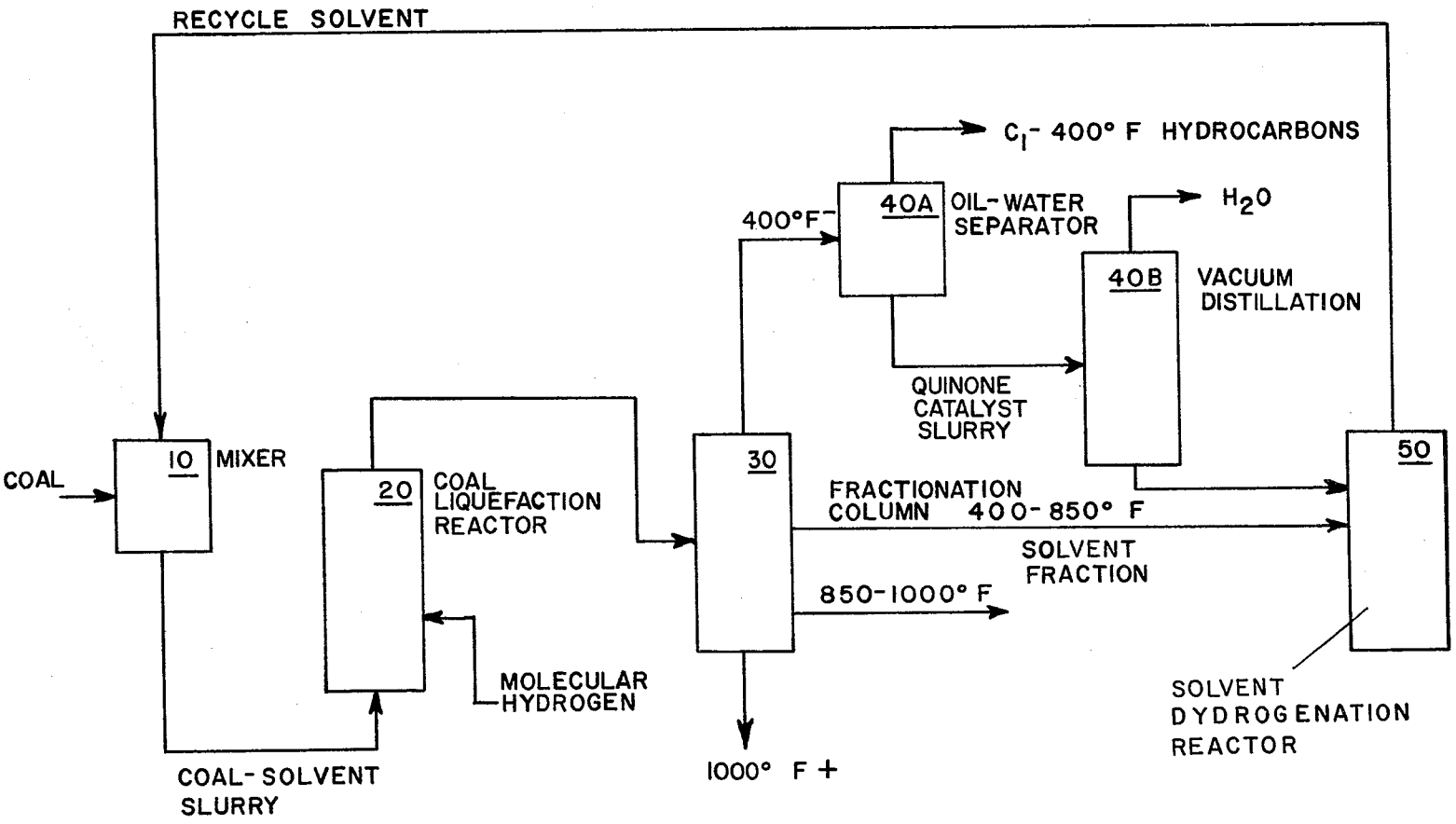
RECYCLE SOLVENT
10
MIXER
COAL
20
COAL LIQUEFACTION REACTOR
MOLECULAR HYDROGEN
COAL-SOLVENT SLURRY
30
400°F-
1000° F +
850-1000° F
FRACTIONATION COLUMN
400-850° F
SOLVENT FRACTION
40A
OIL-WATER SEPARATOR
$C_1$-400° F HYDROCARBONS
QUINONE CATALYST SLURRY
40B
VACUUM DISTILLATION
$H_2O$
50
SOLVENT DYDROGENATION REACTOR

HYDROGEN DONOR SOLVENT COAL LIQUEFACTION PROCESS

RELATED APPLICATION

This is a continuation-in-part of application Ser. Nos. 686,813 now U.S. Pat. No. 4,049,536; 686,814 now U.S. Pat. No. 4,049,537; 686,827 now U.S. Pat. No. 4,051,012. and 686,828, filed May 17, 1976.

Hydrogen donor solvent processes for use in the hydrogenation and liquefaction of coal are of particular interest among known coal conversion processes for the production of useful petroleum-like liquids, i.e., 1000° F.− liquid products. In such processes, crushed coal is contacted at elevated temperature and pressure with a solvent, often a liquid fraction derived from within the process, which acts as a hydrogen transfer agent or donor. The solvent supplies hydrogen to the hydrogen-deficient coal molecules, as molecules are thermally cracked and cleaved from the disintegrating coal solids.

Coal is largely comprised of polymerized multi-ring aromatic structures, and in the breaking coal molecules each bond rupture results in the formation of extremely reactive free radicals. These moities, when early stabilized by the addition of a hydrogen atom, if sufficiently small may be evolved as a portion of the desired petroleum-like liquid product. If the moities become excessively large before they are stabilized, undesirable 1000° F.+ liquid products can form. Also, the moities can form polymeric products, and the fragments may remain with, or form a part of the char or coke that is produced. Sufficient hydrogen must be available, and effectively utilized to avoid repolymerization of the moities to form char or coke. In the various competing reactions, however, gases, liquids and solids are inevitably formed; albeit effort continues to increase the amount of petroleum-like liquids that are formed. In conventional practice, in any event, the gases are separated from the heavier products and the hydrocarbonaceous effluent slurry is fractionated into $C_1$-400° F., 400°-750° F., 750°-1000° F. and 1000° F.+ bottoms. Typically the 400°-750° F. fraction is comprised of hydrogen donor compounds and accordingly, all or a portion of this fraction (or a 400°-850° F. fraction) is rehydrogenated in a hydrotreater, admixed and slurried with fresh coal, and then recycled to the coal liquefaction zone.

Quinones have been employed as carbon radical scavengers in coal liquefaction processes, as disclosed, e.g., in U.S. Pat. No. 3,700,583 issued to Salamony et al on Oct. 24, 1972. The Salamony et al process describes the use of quinones, particularly quinone derivatives of mono- and/or polynuclear aromatic compounds, and certain halogens and hydrogen halides as carbon-radical scavengers which are added with the hydrogen donor solvent fed to the coal liquefaction zone to increase the amount of liquid products, as measured by an increase in total amount of benzene-soluble liquids in the product. A preferred technique for adding quinones to the solvent, in accordance with Salamony et al, is to treat an indigenous 700°-1000° F. fraction of the liquid product in an oxidation zone to form the quinones, or carbon radical scavengers, in situ, and then to recycle such stream via the coal mixing zone to the coal liquefaction zone.

Quinones have also been used as hydrogen transfer catalysts in coal liquefaction processes as disclosed in U.S. application Ser. Nos. 686,813 now U.S. Pat. No. 4,049,536; 686,814 now U.S. Pat. No. 4,049,537; 686,827 now U.S. Pat. No. 4,051,012; and 686,828 by Plumlee et al, filed May 17, 1976, supra. In the Plumlee et al process a particulate coal feed is admixed with a hydrogen donor solvent to which a quinone has been added, and the mixture is then reacted in a coal liquefaction zone at conditions sufficient to hydroconvert and liquefy the coal. The products are then separated into fractions inclusive of a donor solvent fraction, the donor solvent fraction is hydrotreated in a hydrogenation zone in the presence of the quinone catalyst, and the hydrogenated solvent fraction is then recycled to said coal liquefaction zone. In this process, unlike the process of Salamony et al, the quinones accelerate the transfer of hydrogen to stabilize the free radicals formed by the disintegrating coal molecules, this resulting in an increase in liquid yield and decrease of coke or char due to the more effective hydrogen transfer produced by the quinone catalyst which suppresses recombination of the free radicals that tend to form high boiling polymers.

Whereas the process of Plumlee et al offers these and other advantages over prior art processes, such process has nonetheless been found susceptible of further improvement.

Among the objects of this invention are:

To provide a new and improved process wherein quinone catalysts are regenerated in situ within a hydrogen donor solvent process, admixed or slurried with fresh coal, and then recycled to the coal liquefaction zone to catalyze the coal liquefaction reaction and produce desirable 1000° F.− petroleum-like liquid products.

To provide a new and improved hydrogen donor coal liquefaction process, particularly one which utilizes a rich mixture of the ortho- and para- dihydroxy benzene isomers produced in situ and employed as a catalyst to produce greater quantities of the more useful petroleum-like liquids, with decreased amounts of char and coke.

These objects and others are achieved in accordance with the present invention wherein it has been discovered that an indigenous hydrocarbon product stream boiling within a range of from about $C_1$-700° F., preferably from about $C_1$-400° F., can be treated to produce an upgraded hydrocarbon fuel component and also a component which can be recycled to the coal liquefaction zone (or zones), or hydrotreating zone (or zones), or both, to catalyze either, or both, of these reactions. In accordance therewith, a liquid hydrocarbon fraction with a high end boiling point ranging up to about 700° F., preferably up to about 400° F., is separated from the coal liquefaction zone effluent, the separated fraction is contacted with an alkaline medium and neutralized to provide a hydrocarbon phase and an aqueous extract phase, and the aqueous phase is contacted with a peroxygen compound to convert indigenous components of the aqueous phase of said hydrocarbon fraction into catalytic components, such that the aqueous stream is suitable for recycle to the coal liquefaction zone, or hydrotreating zone, or both. Naturally occurring phenols and alkyl substituted phenols, found in the aqueous phase, are converted, by the addition of hydroxyl constituents to phenols, to dihydroxy benzenes which, as disclosed in said copending applications of K. W. Plumlee et al, supra, are suitable hydrogen transfer catalysts.

The indigenous liquid hydrocarbon fraction boiling from about $C_1$-400° F. has been found to contain most of the phenol and alkyl substituted phenols, and the use of this stream is particularly preferred in the practice of this invention. This stream is contacted, washed or extracted with a dilute aqueous alkali solution in amount sufficient to remove phenolic compounds from the liquid hydrocarbon fraction, suitably at ambient temperature or temperature ranging from about 30° to about 210° F., and at ambient pressure. The hydrocarbon phase that is produced is virtually completely denuded of phenolic compounds and is upgraded by virtue of the separation of the phenolic compounds therefrom in that, inter alia, further hydrotreating and refinement of this fraction to produce a desirable fuel requires considerably less hydrogen. The separated aqueous phase, which generally contains from about 10 percent to about 20 percent phenols, based on the weight of the total aqueous system, is next neutralized by contact with an acid, e.g. hydrochloric acid, sulfuric acid, or the like, and the neutralized aqueous fraction then contacted and treated with a peroxygen compound, or compounds, at conditions suitable to convert the phenolic compounds to dihydroxy benzenes. Such conversion reaction, which can be conducted concurrent with the neutralization step or in a separate step, as may be desired, is generally conducted at temperatures ranging from ambient up to the boiling temperature of the aqueous phase, suitably from about 30° to about 210° F., and preferably from about 100° to about 180° F. Pressure is not critical, and the reaction is generally conducted at ambient pressure.

The peroxygen compound is added in amount sufficient to hydroxylize or introduce hydroxyl groups into the nuclei of the phenolic compounds and thereby convert said phenolic compounds into hydroquinones. Hydrogen peroxide, or an admixture of hydrogen peroxide and a metal salt, or an admixture of hydrogen peroxide and an organic carboxylic acid, or a reaction product of hydrogen peroxide and an organic carboxylic acid, preferably one wherein the organic carboxylic acid is characterized as containing from one to about 4 carbon atoms and contains one carboxyl group, constitutes a preferred peroxygen compound, or compound capable of converting the phenols to dihydroxy benzenes, or hydroquinones. Preferably both the hydrogen peroxide and organic carboxylic acid, or reaction product thereof, are employed in the reaction. Exemplary of the organic carboxylic acids which can be added with, or reacted with the hydrogen peroxide, are formic acid, acetic acid, propionic acid, butanoic acid, pentanoic acid, and the like. Formic acid is preferred, and produces higher hydroxylation of the phenolic compounds on a weight basis than the higher molecular weight organic carboxylic acids.

In conducting the hydroxylation reaction, the hydrogen peroxide and organic carboxylic acid can be added in substantially stoichiometric amounts, but preferably each are added in amounts ranging from about 0.1 to about 0.6 moles, more preferably from about 0.2 to about 0.4 moles, based on the moles of phenolic compounds to by hydroxylated. Preferably also, a strong mineral acid is added to catalyze the hydroxylation reaction, e.g., hydrogen chloride, sulfuric acid, nitric acid, phosphoric acid, or the like.

The quinone catalyst generated in situ in accordance with the present invention is characterized as an admixture of quinone compounds, a quinone compound of such admixture being identified as a compound wherein two keto or hydroxy groups are connected by a system of conjugated double bonds. It is a mono-or polycyclic hydrocarbon compound which contains two oxygen atoms which occupy either ortho or para positions, one oxygen atom relative to the other. Where the quinone (or hydroquinone) is polycyclic, the rings constituting the molecule can be fused or non-fused, or can contain both fused and non-fused rings. The quinone generally contains from 1 to about 3 rings in the total molecule, and most often from 1 to about 2 rings. The rings can be substituted or unsubstituted, and generally the rings are substituted. In terms of carbon atoms the total molecule generally contains from about 6 to about 20 carbon atoms, most often from 6 to about 12 carbon atoms. The keto or hydroxy groups, while occupying positions ortho or para one to the other, can be located on the same or different rings. Polynuclear polyquinones are present, but the diquinones are present in highest concentration. Exemplary of quinone compounds found in such admixture are major hydroquinone components such as ortho and para dihydroxybenzene; methyl, ethyl and propyl substituted ortho and para dihydroxybenzene; dimethyl substituted ortho and para dihydroxybenzene and trimethyl and methylethyl substituted ortho and para dihydroxybenzene. These compounds are produced from the corresponding alkyl substituted phenol in the feedstock, e.g., phenol, methyl, ethyl and propyl substituted phenol. Significant amounts of the ortho and para isomers are formed in the addition of the hydroxyl group but negligible amounts of the meta isomers are formed. The ortho-hydroquinones are a preferred species, as contrasted with the para-hydroquinones and fortunately, the orthohydroquinones are present in an essentially 2:1 mole concentration relative to the para-hydroquinones. The least catalytically effective isomer, i.e., the meta-dihydroxy benzenes, are usually present only in trace amounts within the admixture.

In a preferred embodiment, the generated admixture of quinone (hydroquinone) compounds, alone or in admixture with additional quinone (or hydroquinone) compounds from another source, is added to a liquid fraction separated from the liquid products obtained from within the process, suitably a fraction boiling within the range of from about 350° to about 850° F., and preferably from about 400° to about 700° F. These fractions have been found admirably suitable as a solvent donor, solvent donor vehicle or precursor, and generally contain about 30 percent, and most often about 50 percent, of an admixture of hydrogen donor compounds, adequate to supply the necessary hydrogen under coal liquefaction conditions, based on the total weight of the recycled solvent. Where such amounts of hydrogen donor compounds are not present in a given solvent vehicle, additional amounts of these materials can be produced. Suitably, the quinone compound is added to the solvent fraction in quantity ranging from about 0.01 to about 5 percent, preferably from about 0.1 to about 2 percent, based on the weight of total solvent fed into the coal liquefaction zone.

Preferred hydrogen donor compounds are added to, or generated in situ from precursors contained within a suitable solvent donor vehicle, these including indane, dihydronaphthalene, $C_{10}$–$C_{12}$ tetrahydronaphthalenes, hexahydrofluorine, the dihydro-, tetrahydro-, hexahydro-, and octahydro-phenanthrenes, $C_{12}$–$C_{13}$ acenaphthenes, the tetrahydro-, hexahydro- and decahydropyrenes, the ditetra- and octahydro-anthracenes, and other derivatives of partially saturated aromatic compounds. In terms of hydrogen donor potential, the solvent to which the quinone compound has been added, at the time of its introduction into or use within the coal liquefaction zone, necessarily contains at least about 0.8 percent, and preferably from about 1.2 to about 3 percent of donatable hydrogen, based on the weight of total solvent introduced into the coal liquefaction zone. The preferred hydrogen donor solvent is one produced within the coal liquefaction process, and one which contains suitable quantities of hydrogen donor precursors.

In the best mode of practicing the present invention, the admixture of hydroquinone compounds, is employed as a homogenous catalyst to hydrogenate a hydrogen donor solvent fraction produced from within the coal liquefaction process. In such process, schematically illustrated by reference to the FIGURE, the required process steps include (a) a mixing zone 10 within which particulate coal is slurried with an internally generated liquid solvent donor fraction, (b) a coal liquefaction zone 20 within which the coal slurry is fed, and the coal liquefied, (c) a distillation and solids separation zone 30 within which a 400° F.- fraction, a liquid solvent fraction, a liquid product fraction, and a 1000° F.+ heavy bottoms fraction, (d) a quinone catalyst generation zone 40 wherein an admixture of hydroquinone catalysts are generated from phenolic components contained in the 400° F− fraction separated in fractionation column 30, are separated, and (e) a catalytic solvent hydrogenation zone 50 wherein the liquid solvent fraction is hydrogenated in the presence of the hydroquinone catalyst admixture, and the hydrogenated solvent is recycled as a hydrogen donor solvent to said coal liquefaction zone. Preferably the hydroquinone catalyst admixture is recycled with the solvent to the coal liquefaction zone but, if desired, can be removed from the recycle solvent.

In the mixing zone 10, particulate coal of size ranging up to about ⅛ inch particle size diameter, suitably 8 mesh (Tyler), is slurried in recycle solvent. The solvent and coal are admixed in a solvent-to-coal ratio ranging from about 0.8:1 to about 2:1, preferably about 1.2:1 to about 1.6:1, based on weight. The solvent is one which boils within the range of about 350° to about 850° F., preferably from about 400° to about 700° F. The coal slurry is fed, with molecular hydrogen, into the coal liquefaction zone 20.

Within the coal liquefaction zone 20, liquefaction conditions include a temperature ranging from about 700° to about 950° F., preferably from about 800° to about 900° F., with pressures ranging from about 300 psig to about 3000 psig, preferably from about 800 psig to about 2000 psig. Preferably, molecular hydrogen is also added to the liquefaction zone 20 at a rate from about 1 to about 6 weight percent (MAF coal basis), liquid residence times ranging from about 5 to about 130 minutes, and preferably from about 10 to about 60 minutes.

The product from the coal liquefaction zone 20 consists of gases and liquids, the liquids including a mixture of undepleted hydrogen-donor solvent, depleted hydrogen-donor solvent, dissolved coal, undissolved coal and mineral matter. The liquid mixture is transferred into a separation zone 30 wherein a light fraction boiling below 400° F. and an intermediate fraction boiling, e.g., from 400° to 850° F., are recovered, the latter for use as a hydrogen donor solvent. A heavier fraction boiling from about 850° to 1000° F. is also recovered and, as well, a bottoms fractions boiling above 1000° F., including char. The latter is generally used in a gasification process or for coking, as desired.

The 400° F.− liquid hydrocarbon product stream withdrawn from fractionation column 30, and introduced into the quinone catalyst generation zone 40, generally contains from about 10 to about 20 percent of phenolic compounds, based on the total weight of said stream. Within zone 40, the 400° F− liquid hydrocarbon product stream is contacted with an alkaline medium, suitably a dilute aqueous alkali solution, e.g., sodium hydroxide, ammonium hydroxide, potassium hydroxide or the like, to produce hydrocarbon and aqueous phases. The aqueous phase, which contains essentially all of the phenolic compounds is neutralized with acid, and contacted with a peroxygen compound, suitably as described and at the conditions described, to convert the phenolic compounds to hydroquinones. The generated hydroquinone catalyst admixture, alone or in admixture with additional quinones, can then be introduced into the solvent hydrogenation reactor 50 or, if desired fed directly or indirectly to the coal liquefaction reactor 20.

The solvent fraction, or 400°–850° F. fraction, is also introduced into a solvent hydrogenation zone 50 and hydrogenated in the presence of a quinone catalyst to upgrade the hydrogen content of that fraction. The conditions maintained in hydrogenation zone 50 effectively hydrogenate and, if desired, conditions can be provided which produce substantial cracking. Temperatures normally range from about 500° to about 1000° F., preferably from about 750° to about 900° F., and pressures suitably range from about 650 psig to about 2000 psig, preferably from about 1000 psig to about 1400 psig. The hydrogen treat rate ranges generally from about 500 to about 10,000 SCF/B, preferably from about 1000 to about 5000 SCF/B.

These and other features of the present process will be better understood by reference to the following exemplary data. All units are in terms of weight unless otherwise specified.

EXAMPLES

Caustic Extraction 1000 ml of an I.B.P. to 400° F. boiling range fraction (naphtha) from a Donor Solvent Coal Liquefaction process was caustic extracted to remove the phenolic components. The caustic extraction was performed by vigorously mixing the 1000 ml naphtha sample with a caustic solution composed of 40 grams of sodium hydroxide and 200 ml of water for 30 minutes. The denser, phenol containing, water phase was drawn off using a large separatory funnel and the extracted naphtha analyzed by mass spectrometry to determine the extent of extraction. Ninety percent of the original 20 weight percent of phenolic material in the naphtha was extracted through this procedure. The water phase was then neutralized with 100 ml of concentrated hydrochloric acid and the water removed by vacuum distillation. The product of this distillation was a 60% water-40% phenol mixture. This product was used as a phenol feed in a subsequent hydroquinone synthesis. The major phenolic components of the phenol feedstock as analyzed by mass spectrometry are; phenol, methy, ethyl, and propyl substituted phenol, dimethyl substituted phenol and trimethyl and methylethyl substituted phenol.

Hydroquinone Synthesis 60 grams of the extracted phenol feedstock mixture was mixed with 0.1 gram concentrated phosphoric acid. 6 grams of 30% hydrogen peroxide solution was mixed with 1.2 grams of formic acid. The phenol-phosphoric acid solution was heated with moderate stirring in a beaker on a magneticly stirring hotplate to 176° F. The hydrogen peroxide-formic acid solution was added drop-wise from a dropping funnel to this mixture over a 20 minute period. The total mixture was then held at 176° F. for an additional 100 minutes. The mixture was then allowed to cool to room temperature and extracted with 100 ml of diethyl ether. The ether extract was then separated in a separatory funnel and the water phase discarded. The ether was then vacuum distilled at room temperature, and the resultant product analyzed by mass spectrometry. The analysis showed that 20% of the phenolic feed had been converted to hydroquinones.

This feed is found an excellent catalyst when fed into the coal liquefaction zone with regenerated recycle donor solvent.

It is apparent that various modifications and changes can be made without departing the spirit and scope of the present invention.

Having described the invention what is claimed is:

1. In a process for liquefying a particulate coal feed to produce useful petroleum-like liquid products by the steps of (a) contacting, in a liquefaction zone, said coal feed with a hydrogen donor solvent at temperature and pressure sufficient to hydroconvert and liquefy the coal, (b) separating the product from the liquefaction zone into fractions inclusive of a $C_1-700°$ F. liquid hydrocarbon fraction and a liquid solvent fraction which contains at least 30 weight percent hydrogen donor compounds, (c) hydrogenating said liquid solvent fraction in a hydrogenation zone, and (d) recycling the hydrogenated liquid solvent mixture to said coal liquefaction zone, the improvement comprising contacting the $C_1-700°$ F. liquid hydrocarbon fractions with an aqueous alkaline medium to form a hydrocarbon phase and an aqueous extract phase which contains an admixture of indigenous phenolic compounds, neutralizing said aqueous extract phase with acid, contacting said neutralized aqueous phase with hydrogen peroxide to introduce hydroxyl groups into the nuclei of the phenolic compounds to convert said phenolic compounds into hydroquinones which can function in a coal liquefaction zone as a quinone catalyst, and then recycling said hydroquinones, with said hydrogenated liquid solvent mixture, to said coal liquefaction zone to catalyze the coal liquefaction reaction.

2. The process of claim 1 wherein the liquid hydrocarbon fraction contacted with the alkaline medium is a $C_1$-400° F. fraction.

3. The process of claim 1 wherein the $C_1$-700° F. liquid hycrocarbon fraction is contacted with the alkaline medium at temperatures ranging from about 30° to about 210° F.

4. The process of claim 1 wherein hydrogen peroxide contacted with the aqueous phase to introduce the hydroxyl groups into the nuclei of the phenolic compounds is admixed with an organic carboxylic acid.

5. The process of claim 4 wherein the organic carboxylic acid is one containing from 1 to 4 carbon atoms, and one carboxylic acid group.

6. The process of claim 5 wherein the organic carboxylic acid is formic acid.

7. The process of claim 1 wherein the liquid solvent fraction contains at least 50 weight percent of hydrogen donor compounds.

8. The process of claim 7 wherein the liquid solvent fraction is one boiling within about a 350° to 850° F. range.

9. The process of claim 1 wherein the admixture of hydroquinone compounds is added to the hydrogenated liquid recycle solvent in concentration ranging from about 0.01 to about 5 percent, based on the weight of the feed before recycling.

10. The process of claim 9 wherein the admixture of hydroquinone compounds is added in a concentration within the range from about 0.1 to about 2 percent.

* * * * *